US012140378B2

(12) United States Patent
Wei et al.

(10) Patent No.: US 12,140,378 B2
(45) Date of Patent: Nov. 12, 2024

(54) HEAT EXCHANGER

(71) Applicant: ZHEJIANG DUNAN ARTIFICIAL ENVIRONMENT CO., LTD., Zhejiang (CN)

(72) Inventors: Wenjian Wei, Zhejiang (CN); Guanjun Wang, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 221 days.

(21) Appl. No.: 17/761,209

(22) PCT Filed: Aug. 12, 2020

(86) PCT No.: PCT/CN2020/108579
§ 371 (c)(1),
(2) Date: Mar. 17, 2022

(87) PCT Pub. No.: WO2021/052066
PCT Pub. Date: Mar. 25, 2021

(65) Prior Publication Data

US 2022/0341670 A1 Oct. 27, 2022

(30) Foreign Application Priority Data

Sep. 20, 2019 (CN) ..... 201910894398.0

(51) Int. Cl.
*F28F 9/26* (2006.01)
*F28D 1/053* (2006.01)

(52) U.S. Cl.
CPC ..... *F28D 1/05308* (2013.01); *F28F 9/26* (2013.01)

(58) Field of Classification Search
CPC ..... F28D 1/05308; F28F 9/26
See application file for complete search history.

(56) References Cited

U.S. PATENT DOCUMENTS 3,000,193 A * 9/1961 Crider ..... F24F 5/001 62/449
3,097,507 A * 7/1963 Makuh ..... F25B 39/02 165/77
4,546,820 A * 10/1985 Whipple ..... F28D 1/0435 165/77
5,915,469 A * 6/1999 Abramzon ..... B64D 13/00 165/146
6,360,817 B1 * 3/2002 Brochin ..... F28D 1/0417 165/77

(Continued)

FOREIGN PATENT DOCUMENTS

CN 101738123 A 6/2010
CN 101788213 A * 7/2010

(Continued)

*Primary Examiner* — Devon Russell
(74) *Attorney, Agent, or Firm* — Samson G. Yu

(57) ABSTRACT

Disclosed is a heat exchanger, including: at least two heat exchange tube groups—wherein each heat exchange tube group includes at least two heat exchange tubes; and a connecting member, wherein the at least two heat exchange tubes are communicated with each other by the connecting member—the at least two heat exchange tube groups are connected by the connecting member, and the at least two heat exchange tube groups are not communicated with each other.

8 Claims, 4 Drawing Sheets

(56) References Cited

U.S. PATENT DOCUMENTS

| | | | | |
|---|---|---|---|---|
| 6,732,790 | B2 * | 5/2004 | Brochin | F28D 1/0417 165/77 |
| 6,901,992 | B2 * | 6/2005 | Kent | F28F 21/067 180/68.4 |
| 2008/0156014 | A1 | 7/2008 | Kopko et al. | |
| 2010/0132917 | A1 * | 6/2010 | Runk | F28D 1/0443 165/67 |
| 2018/0003448 | A1 * | 1/2018 | Wu | F28D 1/05383 |

FOREIGN PATENT DOCUMENTS

| | | | |
|---|---|---|---|
| CN | 201731684 | U | 2/2011 |
| CN | 102401604 | A | 4/2012 |
| CN | 103047895 | A | 4/2013 |
| CN | 103148729 | A | 6/2013 |
| CN | 104981674 | A | 10/2015 |
| CN | 107560484 | A | 1/2018 |
| CN | 210922282 | U | 7/2020 |

* cited by examiner

HEAT EXCHANGER

CROSS-REFERENCE TO RELATED APPLICATION(S)

The present disclosure is a national stage application of International Patent Application No. PCT/CN2020/108579, which is filed on Aug. 12, 2020. The present disclosure claims priority to Patent Application No. 201910894398.0, filed to the China National Intellectual Property Administration on Sep. 20, 2019 and entitled "Heat Exchanger".

TECHNICAL FIELD

The present disclosure relates to the technical field of heat exchange devices, in particular to a heat exchanger.

BACKGROUND

Most of heat exchangers with an A-type structure in a technology known to inventors are designed as an evaporator, and are directly bent from a middle of the heat exchanger. A bending portion is difficult to process, the overall structure is complicated, and the bending may also produce a certain influence on a heat exchange performance of the heat exchanger. In addition, the heat exchanger is usually arranged in a symmetrical structure, and a flow area of a heat exchange channel of the heat exchanger on a flow path from an inlet to an outlet remains unchanged, so that the heat exchange effect thereof is poor.

SUMMARY

Some embodiments of the present disclosure provide a heat exchanger, as to solve a problem that the structure of the heat exchanger with an A-type structure in a technology known to inventors is complicated.

Some embodiments of the present disclosure provide a heat exchanger, including: at least two heat exchange tube groups, wherein the heat exchange tube group includes at least two heat exchange tubes; and a connecting member, wherein the at least two heat exchange tubes in the each heat exchange tube group are communicated with each other by the connecting member, the at least two heat exchange tube groups are connected by the connecting member, and the two heat exchange tube groups are not communicated with each other.

In an embodiment, the connecting member includes a plate member and a plurality of communication portions, the plate member and the plurality of communication portions form communication cavities, and each communication cavity is communicated with the at least two heat exchange tubes in the each heat exchange tube group.

In an embodiment, the connecting member has a heat exchange tube groove into which the heat exchange tube is inserted.

In an embodiment, the plate member is bent, so that a predetermined included angle is formed between the two heat exchange tube groups.

In an embodiment, the plate member includes: a first plate member, a second plate member, and a connecting portion arranged between the first plate member and the second plate member.

In an embodiment, the connecting portion is integrally arranged with the first plate member and the second plate member, and the connecting portion is protruded towards a side without the heat exchange tube.

In an embodiment, the connecting portion includes a first extension arm extending from a side of the first plate member close to the second plate member and bent, and a first extension arm arranged on the second plate member, wherein the second extension arm is connected with and opposites to the surface of the first extension arm.

In an embodiment, the first plate member and the second plate member are arranged at intervals, the plate member further includes a third plate member, and the first plate member and the second plate member are connected by the third plate member.

In an embodiment, the heat exchange tube and the communication portions are located at a same side of the plate member; or the heat exchange tube and the plate member are located at a same side of the communication portions.

In an embodiment, in a same heat exchange tube group of the at least two heat exchange tube groups, a flow area of the heat exchange tubes at an inlet side is different from a flow area of the heat exchange tubes at an outlet side.

In an embodiment, in a same heat exchange tube group of the at least two heat exchange tube groups, ends of at least two heat exchange tubes away from the connecting member are mutually staggered and arranged.

Some embodiments of the present disclosure are applied, by arranging the connecting member, the heat exchange tube groups are connected by the connecting member, but are not communicated by the connecting member, and the heat exchange tubes in each heat exchange tube group are communicated with each other by the connecting member. In this way, a connection function of the connecting member is to connect the heat exchange tube groups into a whole, so that the heat exchange tube groups exchange heat independently, thereby the heat exchange performance of the heat exchanger is improved. A communication function of the connecting member is to communicate the heat exchange tubes into one heat exchange tube group, and an arrangement mode of a multi-circuit flow such as a double-circuit flow is also beneficial to improve the heat exchange performance. The connecting member itself is simple in structure, and convenient for processing, and the structural complexity of the heat exchanger is greatly reduced.

BRIEF DESCRIPTION OF THE DRAWINGS

Drawings of the description for constituting a part of the present disclosure are used to provide further understanding of the present disclosure, and schematic embodiments of the present disclosure and descriptions thereof are used to explain the present disclosure, and do not constitute improper limitation to the present disclosure. In the drawings.

Herein, the above drawings include the following reference signs:

10. Heat exchange tube group; 11. Heat exchange tube; 12. Communication portion; 20. Plate member; 21.

First plate member; 22. Second plate member; 23. Third plate member; and 30. Connecting member.

DETAILED DESCRIPTION OF THE EMBODIMENTS

It should be noted that embodiments in the present disclosure and features of the embodiments may be combined with each other in the case without conflicting. The present disclosure is described in detail below with reference to the drawings and in combination with the embodiments.

In order to solve a problem that the structure of the heat exchanger with an A-type structure in a technology known to inventors is complicated, some embodiments of the present disclosure provide a heat exchanger.

Embodiment I

Figure 1:
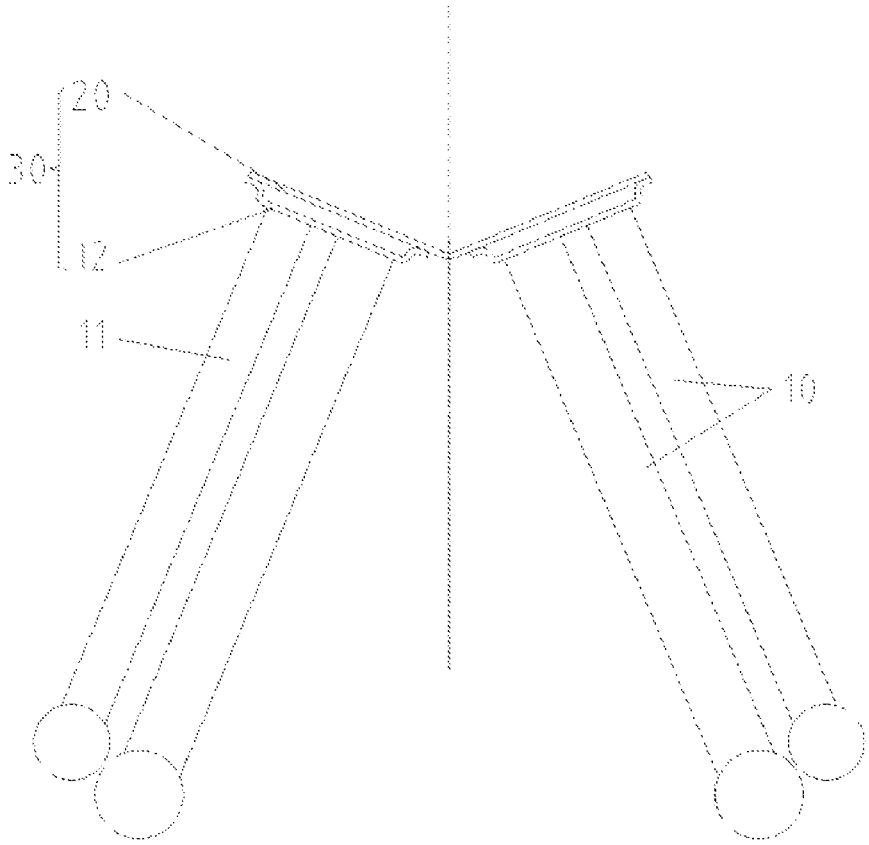
FIG. 1 shows a structure schematic diagram of a heat exchanger in Embodiment I of the present disclosure.

A heat exchanger as shown in FIG. 1 includes at least two heat exchange tube groups 10 and a connecting member 30, and each heat exchange tube group 10 includes at least two heat exchange tubes 11; and the at least two heat exchange tubes 11 are communicated with each other by the connecting member 30, the at least two heat exchange tube groups 10 are connected by the connecting member 30, and the two heat exchange tube groups 10 are not communicated with each other.

In this embodiment, by arranging the connecting member 30, the heat exchange tube groups 10 are connected by the connecting member 30, but are not communicated by the connecting member 30, and the heat exchange tubes 11 in each heat exchange tube group 10 are communicated with each other by the connecting member 30. In this way, a connection function of the connecting member 30 is to connect the heat exchange tube groups 10 into a whole, so that the heat exchange tube groups 10 exchange heat independently of each other, thereby a heat exchange performance of the heat exchanger is improved. A communication function of the connecting member 30 is to communicate the at least two heat exchange tubes 11 into one heat exchange tube group 10, and an arrangement mode of a multi-circuit flow such as a double-circuit flow is also beneficial to improve the heat exchange performance. The structure of the connecting member 30 itself is simple, and convenient for processing, and the structural complexity of the heat exchanger is greatly reduced.

In this embodiment, the connecting member 30 includes a plate member 20 and a plurality of communication portions 12, the plate member 20 and the communication portions 12 form communication cavities, and each communication cavity is communicated with at least two heat exchange tubes 11 in a same heat exchange tube group.

In some embodiments, the communication portion 12 has a convex hull. While the plate member 20 fits the communication portion 12 together, a communication cavity is formed between the convex hull and the plate member 20. The communication portion 12 or the plate member 20 is provided with a heat exchange tube groove, and the heat exchange tube 11 is inserted into the heat exchange tube groove, so that the heat exchange tube 11 is communicated with the communication cavity, and the communication cavity is communicated with a plurality of the heat exchange tubes 11 of the same heat exchange tube group 10 at the same time. The arrangement of the communication cavity achieves the mutual communication between the heat exchange tubes 11 in the same heat exchange tube group, so that fluid is able to flow between the heat exchange tubes 11 of the same heat exchange tube group 10, thereby processes such as heat exchange are performed. Since there is a plurality of the heat exchange tube groups 10 arranged, there is also a plurality of the convex hulls, there is also a plurality of the communication cavities formed by it, and the communication cavities are separated from each other, the heat exchange tubes 11 of each heat exchange tube group 10 are communicated with the same communication cavity, thereby the connection function and the communication function of the connecting member 30 are achieved.

In some embodiments, the plate member 20 is bent, so that a predetermined included angle is formed between the two heat exchange tube groups 10. The bent heat exchanger is a heat exchanger with an A-type structure, so that it may satisfy use requirements of the A-type structure. Since the plate member 20 itself is simple in structure, a bending process is very convenient. In this way, the heat exchange tube 11 does not need to be bent, and the processing difficulty of the heat exchanger is simplified. The specific size of the predetermined included angle may be selected according to the requirements.

The plate member 20 in this embodiment is a stamped sheet metal member formed by bending a plate member, and the specific structure of the plate member 20 may adopt a plurality of arrangement modes. In this embodiment, the plate member 20 is an integral member, and is formed by directly bending the whole plate member. The main advantage of this arrangement mode is that the bending and processing of the plate member 20 are convenient, and the structural complexity and processing difficulty are reduced. The plate member 20 in some embodiments is formed by directly extruding and bending the plate member through a device such as a bending machine. Correspondingly, in order to form the A-type structure, the heat exchange tube group 10 is connected with a surface of an outer side of a bending portion of the connecting member 30. In this way, the bending portion of the connecting member 30 is protruded to an inner side of the A-type structure, namely it is protruded to a middle of the two heat exchange tube groups 10. This structure makes the processing of the plate member 20 very convenient, and the required plate member 20 is obtained only by directly processing it with the bending machine.

In this embodiment, the heat exchange tube 11 and the communication portions 12 are located at a same side of the plate member 20, and the heat exchange tube groove is provided on the communication portion 12.

In this embodiment, in a same heat exchange tube group 10, a flow area of the heat exchange tubes at a side is different from a flow area of the heat exchange tubes at an outlet side. In some embodiments, the flow area of the heat exchange tubes 11 is increased gradually along a direction from the inlet side to the outlet side. Certainly, the flow area of the heat exchange tubes 11 may also be decreased gradually along the direction from the inlet side to the outlet side, and a specific mode may be selected according to an actual situation.

In some embodiments, in a same heat exchange tube group 10, ends of at least two heat exchange tubes 11 away from the connecting member 30 are mutually staggered and arranged.

Embodiment II

A difference from Embodiment I is that a bending manner of the bending portion of the plate member 20 is different.

Figure 2:
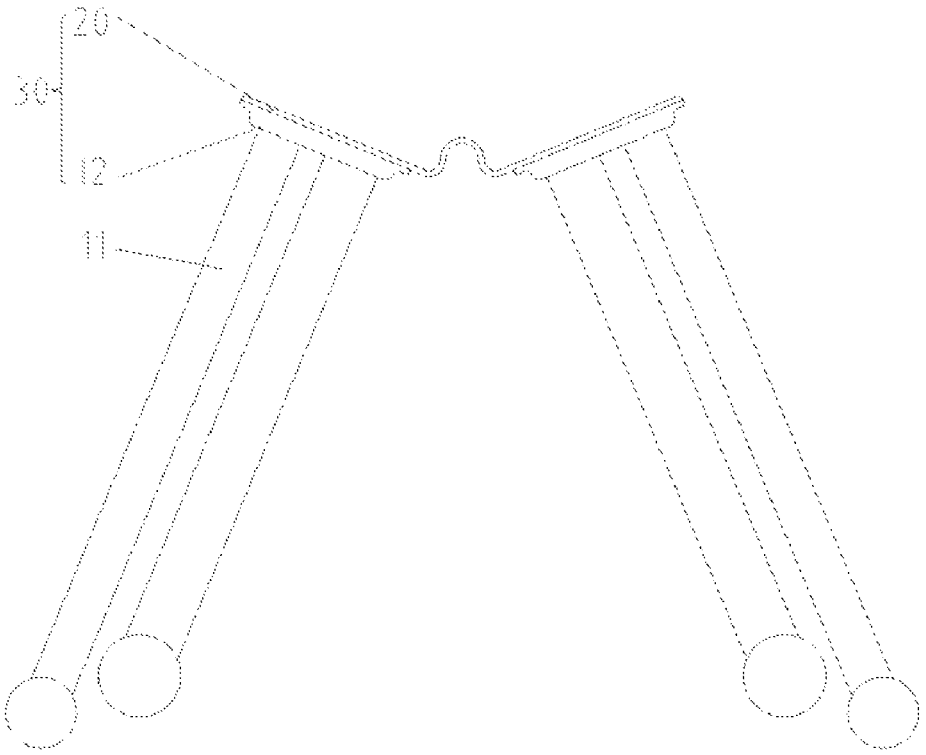
FIG. 2 shows a structure schematic diagram of a heat exchanger in Embodiment II of the present disclosure.

In an embodiment shown in FIG. 2, the plate member 20 includes a first plate member 21, a second plate member 22 and a connecting portion arranged between the first plate member 21 and the second plate member 22. The first plate member 21, the second plate member 22 and the connecting portion are integrally formed as an integral member. A difference is that this embodiment is further processed on the basis of Embodiment I, and the connecting portion is protruded towards a side without the heat exchange tube 11, namely the connecting portion is further bent towards a direction away from the inner side of the A-type structure to form an approximately Ω-shaped structure, thereby a form in FIG. 2 is formed, and the bending portion of the connecting portion is protruded towards the outer side of the A-type structure, namely it is protruded towards the side without the heat exchange tube 11. Although the plate member 20 with this structure is not as easy to process as the plate member 20 in Embodiment I, it improves the structural stability and structural strength of the plate member 20, and it is beneficial to a stable work of the heat exchanger.

Embodiment III

A difference from Embodiment I is that the plate member 20 is arranged in a separate body.

In this embodiment (un-shown in the figure), the plate member 20 includes a first plate member 21 and a second plate member 22 that are processed separately. The first plate member 21 is connected with a heat exchange tube group 10, and the second plate member 22 is connected with another heat exchange tube group 10, a portion in which the first plate member 21 and the second plate member 22 are connected to each other is used as a connecting portion, the two are directly connected together by a mode such as welding at the connecting portion, and while being connected, an included angle other than 180 degrees is formed between the first plate member 21 and the second plate member 22, and then the two are welded together to complete. The overall strength of this structure is high, and the processing is relatively easy.

Embodiment IV

A difference from Embodiment III is that the specific structure of the plate member 20 is different.

Figure 3:
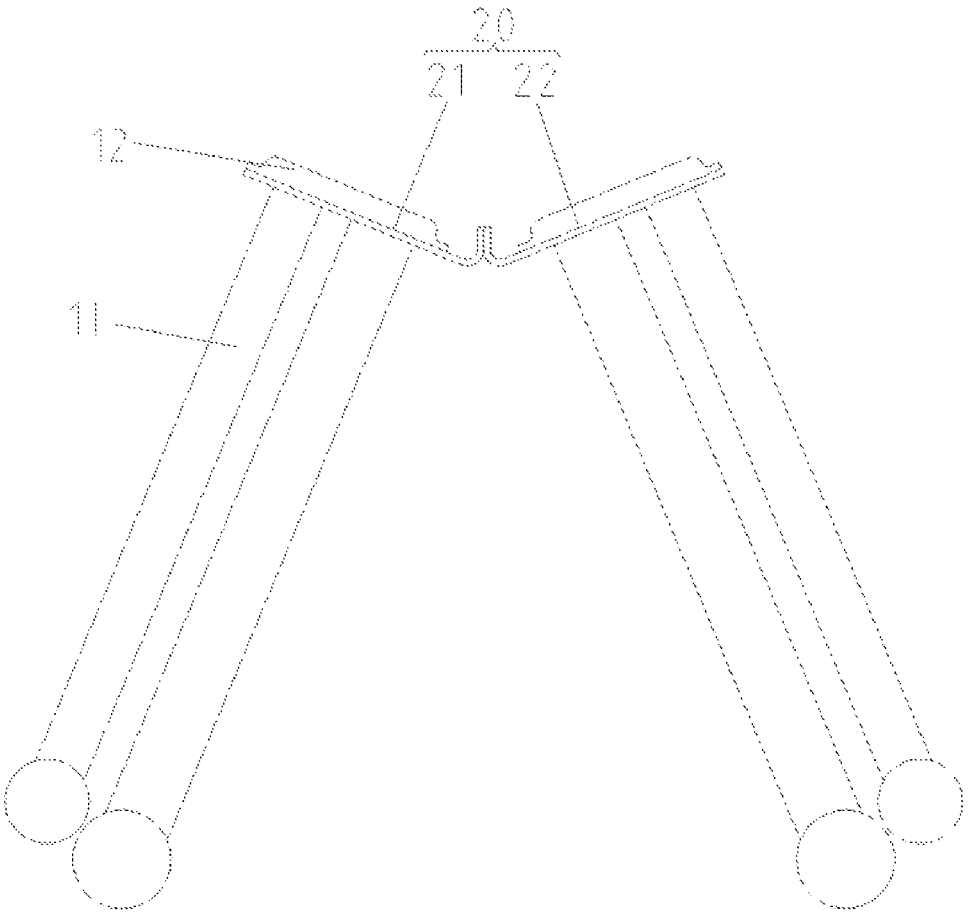
FIG. 3 shows a structure schematic diagram of a heat exchanger in Embodiment IV of the present disclosure.

Based on Embodiment III, while the first plate member 21 and the second plate member 22 in the form of a plate member are directly welded, a welding area between the two is small, it is inconvenient for a welding operation, and may even affect the structural strength. Therefore, the further improvement is made on the basis thereof. As shown in FIG. 3, the connecting portion includes a first extension arm extending from a side of the first plate member 21 close to the second plate member 22 and bent, and a second extension arm arranged on the second plate member 22 and connected to the surface of the first extension arm, the second extension arm opposites to the surface of the first extension arm. While being welded, the welding operation is performed on the opposite surfaces of the first extension arm and the second extension arm. In this way, the connection area between the first plate member 21 and the second plate member 22 is increased, the connection strength between the two is improved, and the connection effect is guaranteed.

It should be noted that while being welded, the first plate member 21 and the second plate member 22 may be placed to form the included angle other than 180 degrees, and then the two are welded together: or the first plate member 21 and the second plate member 22 may be bent after being welded, so that the first plate member 21 and the second plate member 22 form the included angle other than 180 degrees.

Embodiment V

A difference from Embodiment III is that the specific structure of the plate member 20 is different.

Figure 4:
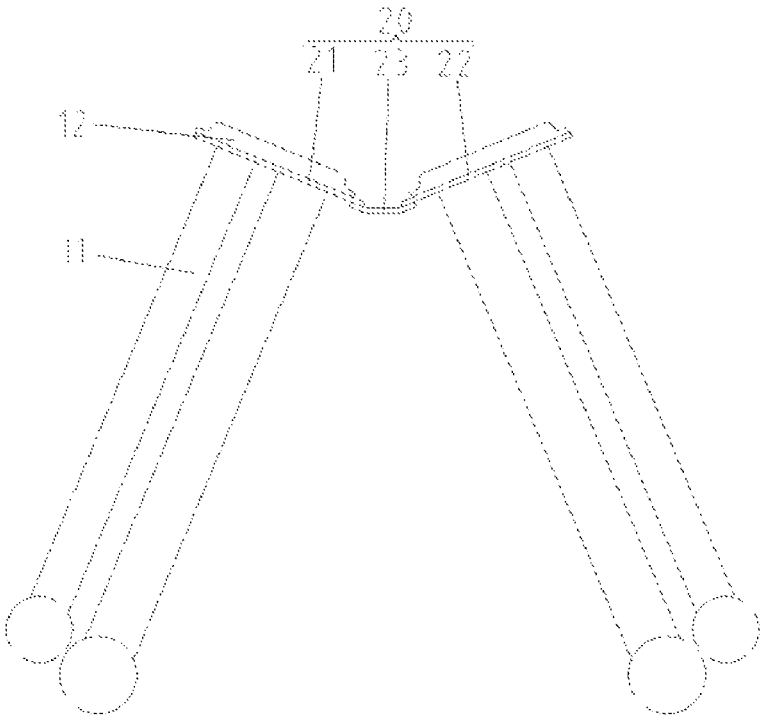
FIG. 4 shows a structure schematic diagram of a heat exchanger in Embodiment V of the present disclosure.

This embodiment is the same as Embodiment IV, is also based on the basis that the plate member 20 in Embodiment is inconvenient to perform the welding operation during the welding process, and is improved on the basis of Embodiment III. As shown in FIG. 4, in addition to the first plate member 21 and the second plate member 22 that are arranged separately, the connecting member 30 further includes a third plate member 23 that is separated, and a surface of the third plate member 23 is connected to surfaces of the first plate member 21 and the second plate member 22. In this way, there is not a direct connection relationship between the first plate member 21 and the second plate member 22, but it is indirectly connected by the third plate member 23, the third plate member 23 is used to improve the connection strength between the various portions of the plate member 20, and the connection effect is guaranteed. In this embodiment, after the first plate member 21 and the second plate member 22 are welded with the third plate member 23 respectively, the third plate member 23 is bent, so that the first plate member 21 and the second plate member 22 form the included angle other than 180 degrees; or while being welded, the first plate member 21 and the second plate member 22 are firstly placed to form the included angle other than 180 degrees, and then welded with the third plate member 23 respectively.

It should be noted that the above Embodiments II to V only list several implementation modes. Certainly, further improvements may be made on the basis of the above embodiments, or a plurality of the embodiments may be combined, or the connecting member 30 in the form of other structures may be adopted.

Embodiment VI

A difference from Embodiment I is that the arrangement positions among the heat exchange tubes 11, the communication portions 12 and the plate member 20 are different.

Figure 5:
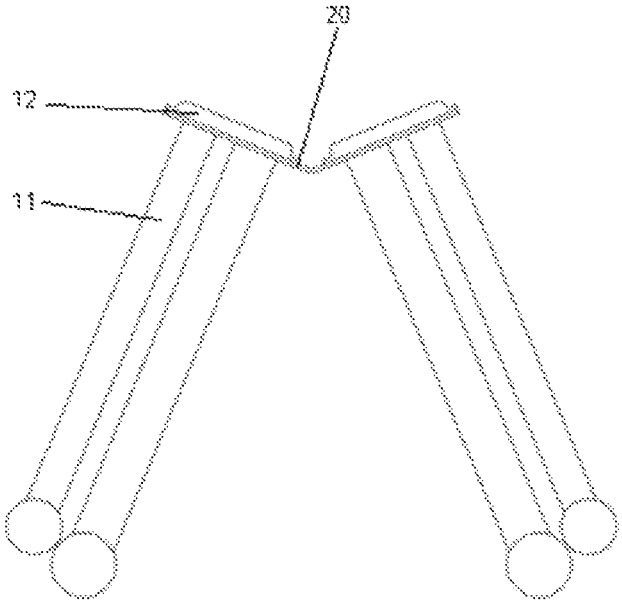
FIG. 5 shows a structure schematic diagram of a heat exchanger in Embodiment VI of the present disclosure.

As shown in FIG. 5, the plate member 20 is provided with a heat exchange tube groove, and the heat exchange tube 11 penetrates through the heat exchange tube groove, as to pass through the plate member 20, and the heat exchange tube 11 and the plate member 20 are located at the same side of the communication portions 12. While being processed, the heat exchange tube 11 passes through the plate member 20 and is communicated with the communication portion 12. In this way, the plate member 20 has a certain supporting effect on the heat exchange tube 11, and the structural strength is improved.

It should be noted that, although the arrangement mode in Embodiment VI is described on the basis of Embodiment I, it is not limited to Embodiment I, and may also be applied to other embodiments. In addition. Embodiment I and Embodiment VI only list several implementation modes, and further improvements may be made on the basis of the above embodiments, or other connection modes may be adopted.

It should be noted that the plurality in the above embodiments refers to at least two.

From the above descriptions, it may be seen that the above embodiments of the present disclosure achieve the following technical effects:

1. The problem that the structure of the heat exchanger with the A-type structure in the technology known to inventors is complicated is solved.

2. The connecting member is simple in structure, the bending process is relatively easy, and it does not produce the influence on the heat exchange performance of the heat exchange tube group.

3. The heat exchange tube groups at both sides of the connecting member are not communicated, and perform heat exchange work independently, thereby the heat exchange performance of the heat exchanger is improved.

4. The arrangement mode of the multi-circuit flow is beneficial to improve the heat exchange performance.

5. The asymmetrical arrangement mode improves the heat exchange performance of the heat exchanger.

Apparently, the above embodiments described are only a part of the embodiments of the present disclosure, but not all of the embodiments. Based on the embodiments in the present disclosure, ail other embodiments obtained by those of ordinary skill in the art without creative work shall fall within a scope of protection of the present disclosure.

The above are only some embodiments of the present disclosure, and are not intended to limit the present disclosure. For those skilled in the art, the present disclosure may have various modifications and changes. Any modifications, equivalent replacements, improvements and the like made within the spirit and principle of the present disclosure shall be included within the scope of protection of the present disclosure.

What is claimed is:

1. A heat exchanger, comprising:

at least two heat exchange tube groups, wherein each heat exchange tube group comprises at least two heat exchange tubes; and a connecting member, wherein the at least two heat exchange tubes in the each heat exchange tube group are communicated with each other by the connecting member, the at least two heat exchange tube groups are connected by the connecting member, and the two heat exchange tube groups are not communicated with each other;

wherein the connecting member comprises a plate member and a plurality of communication portions, each of the plurality of communication portions has a convex hull, the plurality of communication portions correspond to a plurality of convex hulls, the plate member and the plurality of convex hulls form communication cavities, the communication cavities are separated from each other, and each communication cavity is communicated with the at least two heat exchange tubes in the each heat exchange tube group;

wherein in a same heat exchange tube group of the at least two heat exchange tube groups, the same heat exchange tube group comprises one heat exchange tube at an inlet side and one heat exchange tube at an outlet side, a distance from an end of the heat exchange tube located at the inlet side away from the connecting member to the connecting member being different from a distance from an end of the heat exchange tube located at the outlet side away from the connecting member to the connecting member; the heat exchanger tube on the inlet side and the heat exchange tube on the outlet side are arranged parallel in a width direction of the heat exchanger tube; a flow area of the heat exchange tube located at the inlet side is different from a flow area of the heat exchange tube located at the outlet side.

2. The heat exchanger as claimed in claim 1, wherein the connecting member has a heat exchange tube groove into which the heat exchange tube is inserted.

3. The heat exchanger as claimed in claim 1, wherein the plate member is bent, and a predetermined included angle is formed between the two heat exchange tube groups.

4. The heat exchanger as claimed in claim 1, wherein the plate member comprises: a first plate member, a second plate member, and a connecting portion arranged between the first plate member and the second plate member.

5. The heat exchanger as claimed in claim 4, wherein the connecting portion is integrally arranged with the first plate member and the second plate member, and the connecting portion is protruded towards a side without the heat exchange tube.

6. The heat exchanger as claimed in claim 4, wherein the connecting portion comprises a first extension arm extending from a side of the first plate member close to the second plate member and bent, and a second extension arm arranged on the second plate member, wherein the second extension arm is connected with and opposites to a surface of the first extension arm.

7. The heat exchanger as claimed in claim 4, wherein the first plate member and the second plate member are spaced apart from one another, the plate member further comprises a third plate member, and the first plate member and the second plate member are connected by the third plate member.

8. The heat exchanger as claimed in claim 1, wherein the heat exchange tube and the communication portions are located at a same side of the plate member; or the heat exchange tube and the plate member are located at a same side of the communication portions.

* * * * *